US007284737B2

(12) United States Patent
Kane

(10) Patent No.: US 7,284,737 B2
(45) Date of Patent: Oct. 23, 2007

(54) DRINK HOLDER

(76) Inventor: Jeffery L. Kane, 1415 Barneswood La., Rochester Hills, MI (US) 48306

( * ) Notice: Subject to any disclaimer, the term of this patent is extended or adjusted under 35 U.S.C. 154(b) by 183 days.

(21) Appl. No.: 11/214,095

(22) Filed: Aug. 29, 2005

(65) Prior Publication Data

US 2007/0045496 A1 Mar. 1, 2007

(51) Int. Cl.
*A47K 1/08* (2006.01)

(52) U.S. Cl. ..... 248/311.2; 248/226.11

(58) Field of Classification Search ..... 248/226.11, 248/313, 311.2; 224/148.1, 148.4, 270, 441, 224/448, 545, 547, 548, 549, 558, 926
See application file for complete search history.

(56) References Cited

U.S. PATENT DOCUMENTS 820,708 A * 5/1906 Durpey ..... 248/313
4,961,555 A * 10/1990 Egan, Jr. ..... 248/231.81
5,102,086 A * 4/1992 Thomason ..... 248/311.2
5,106,046 A * 4/1992 Rowles et al. ..... 248/311.2
5,865,412 A * 2/1999 Mason ..... 248/311.2
6,036,071 A * 3/2000 Hartmann et al. ..... 224/547
6,766,912 B1 * 7/2004 Gibbs ..... 211/74
2001/0032915 A1 * 10/2001 Clifford ..... 248/311.2
2002/0109062 A1 * 8/2002 Fowler ..... 248/311.2
2003/0197104 A1 * 10/2003 Heybl et al. ..... 248/311.2
2004/0140411 A1 * 7/2004 Roe et al. ..... 248/311.2
2004/0222345 A1 * 11/2004 Lindsay ..... 248/311.2

* cited by examiner

*Primary Examiner*—Carl D. Friedman
*Assistant Examiner*—Bradley H Duckworth
(74) *Attorney, Agent, or Firm*—Howard & Howard Attorneys, P.C.

(57) ABSTRACT

A drink holder system is described, wherein the drink holder system includes a base assembly operable to receive a drink container and a clamp assembly operably associated with the base assembly. The base assembly includes a C-shaped base member having an open end, a C-shaped retainer member having an open end, a plurality of leg members interconnecting the base member and the retainer member, and a plurality of selectively biasable prong members extending from a surface of the retainer member. The clamp assembly includes a bracket member operably associated with the retainer member, a first clamping member slidably received in the bracket member, and a second clamping member operably associated with the bracket member, wherein the second clamping member is operable to bias away from the first clamping member to permit the clamp assembly to selectively clamp onto a surface, such as an edge portion of a table or chair.

17 Claims, 7 Drawing Sheets

DRINK HOLDER

FIELD OF THE INVENTION

The present invention generally relates to drink holders, and more specifically to a drink holder system that can be selectively and removably clamped to an edge portion of a structure.

BACKGROUND OF THE INVENTION

Drink containers can occupy valuable space on certain surfaces such as tables, especially tables that are generally crowded with other items, such as card tables which contain the player's cards, betting chips and/or the like. Drink containers also have a tendency to tip over, especially when the table is crowded with other items, thus potentially spilling the contents of the container onto the table and the other items located thereon.

Accordingly, there exists a need for a new and improved drink holder that can receive any number of types and sizes of drink containers wherein the drink holder can be selectively and removably secured to a structure.

SUMMARY OF THE INVENTION

In accordance with the general teachings of the present invention, the drink holder system is intended to selectively and removably clamp onto an edge portion of a structure (e.g., a table top surface edge or an arm of a chair) so as to be operable to a drink container so as keep the drink container from spilling.

In accordance with one aspect of the present invention, the drink holder system selectively and, removably mounts to the edge of a table, thus allowing for the top of the table to be relatively clear for such things as playing cards (e.g., in conjunction with a card table), board games, puzzles and/or the like. When mounted to a dinner table, the drink holder system will prevent the user from inadvertently contacting and potentially spilling the contents of his or her drink container on the food items on the dinner table (e.g., this may be especially helpful for toddlers, clumsy adults and/or individual with neuromuscular disorders). When mounted to an office desk surface, the drink holder system of the present invention will open up the desk work space and insure that important papers are not damaged from spilled drinks. When mounted to the arm of chair, e.g., an outdoor patio chair, the drink holder system of the present invention will conveniently hold the user's drink right next to him or her. The drink holder system of the present invention can also be mounted to any other type of structure (e.g., window sills, bookcase shelves, end tables, coffee tables, ladder rungs, and/or the like), provided that the structure has a suitable surface (e.g., edge portion) to cooperate with the drink holder system.

The drink holder system of the present invention can receive any number of types and/or sizes of drink containers, such as but not limited to 20-ounce plastic bottles, 12-ounce aluminum cans, 12-ounce beer bottles or wine coolers, typical household plastic and/or glass containers (e.g., juice glasses, tumblers, highball glasses and/or the like), white or red wine glasses (e.g., those with a stem portion located between the base and the container portions), coffee cups or mugs, and/or the like.

In accordance with a first embodiment of the present invention, a drink holder is provided, comprising: (1) a base assembly operable to receive a drink container; and (2) a clamp assembly operably associated with the base assembly, comprising: (a) a first clamping member; and (b) a second clamping member, wherein the second clamping member is operable to bias away from the first clamping member so as to permit the clamp assembly to selectively clamp onto a surface.

In accordance with a second embodiment of the present invention, a drink holder is provided, comprising: (1) a base assembly operable to receive a drink container, comprising: (a) a C-shaped base member having an open end; (b) a C-shaped retainer member having an open end; and (c) a plurality of leg members interconnecting the base member and the retainer member; and (2) a clamp assembly operably associated with the base assembly, comprising: (a) a first clamping member; and (b) a second clamping member, wherein the second clamping member is operable to bias away from the first clamping member so as to permit the clamp assembly to selectively clamp onto a surface.

In accordance with a third embodiment of the present invention, a drink holder is provided, comprising: (1) a base assembly operable to receive a drink container, comprising: (a) a C-shaped base member having an open end; (b) a C-shaped retainer member having an open end; (c) a plurality of leg members interconnecting the base member and the retainer member; and (d) a plurality of selectively biasable prong members extending from a surface of the retainer member; and (2) a clamp assembly operably associated with the base assembly, comprising: (a) a bracket member operably associated with the retainer member; (b) a first clamping member slidably received in the bracket member; and (c) a second clamping member operably associated with the bracket member, wherein the second clamping member is operable to bias away from the first clamping member so as to permit the clamp assembly to selectively clamp onto a surface.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
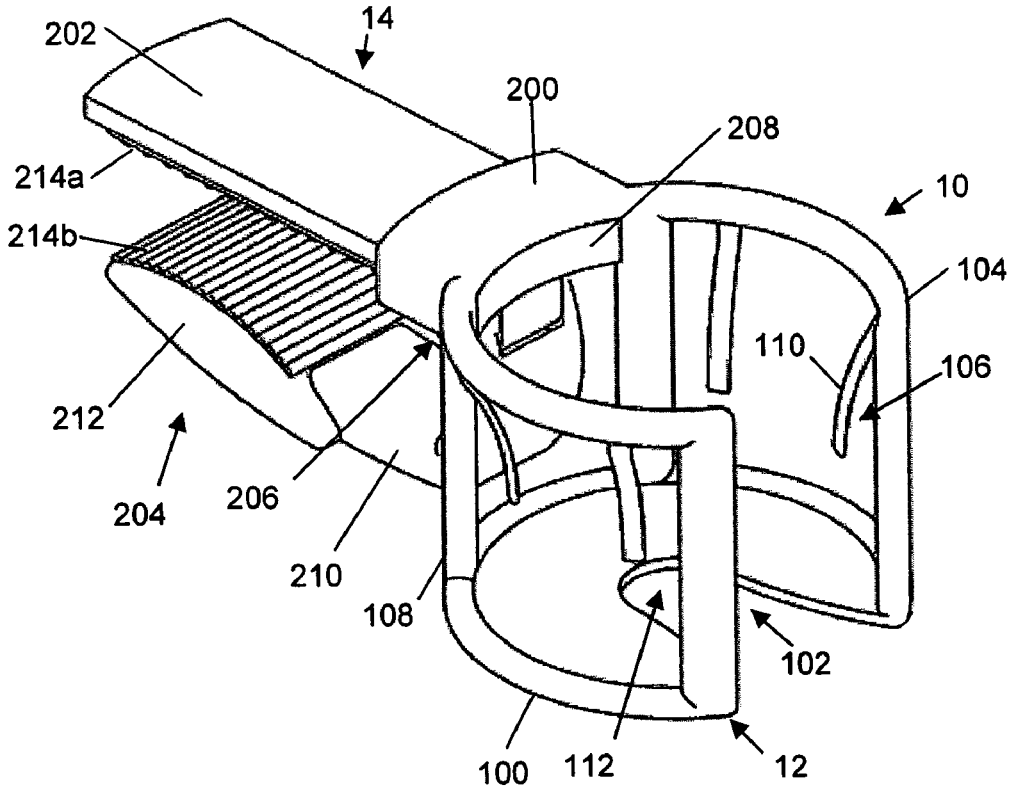
FIG. 1 is a top perspective view of a drink holder system in the deployed position, in accordance with the general teachings of the present invention.
Figure 2:
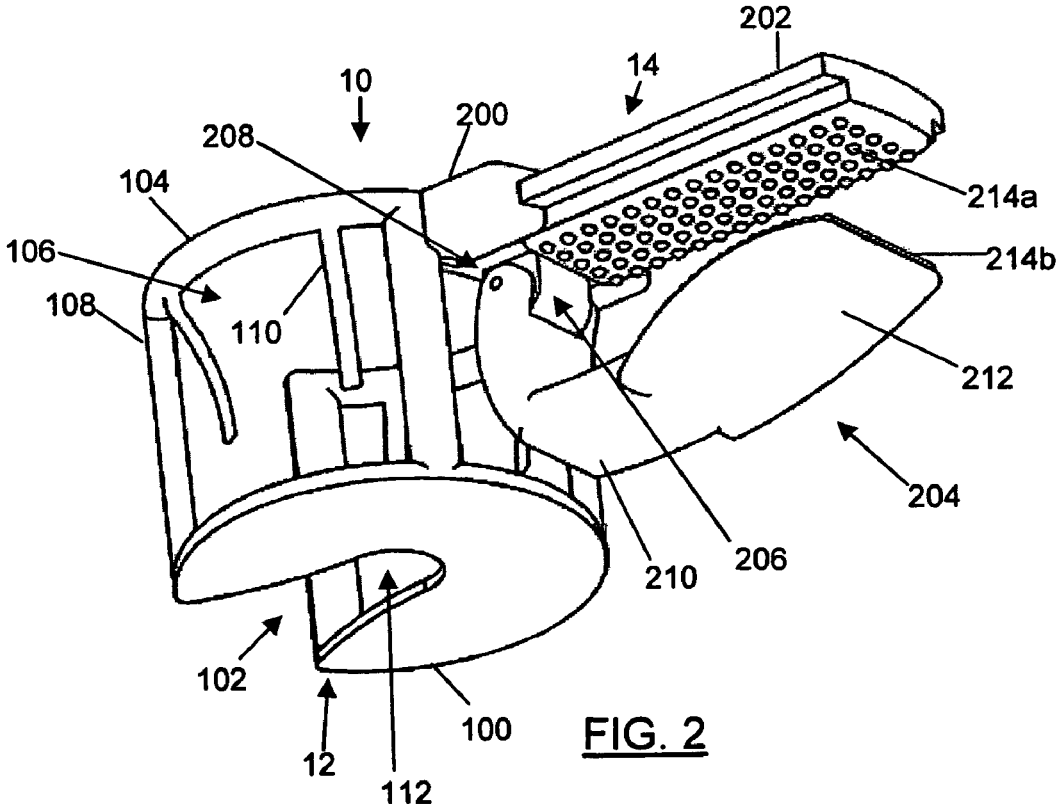
FIG. 2 is a bottom perspective view of a drink holder system in the deployed position, in accordance with the general teachings of the present invention.
Figure 3:
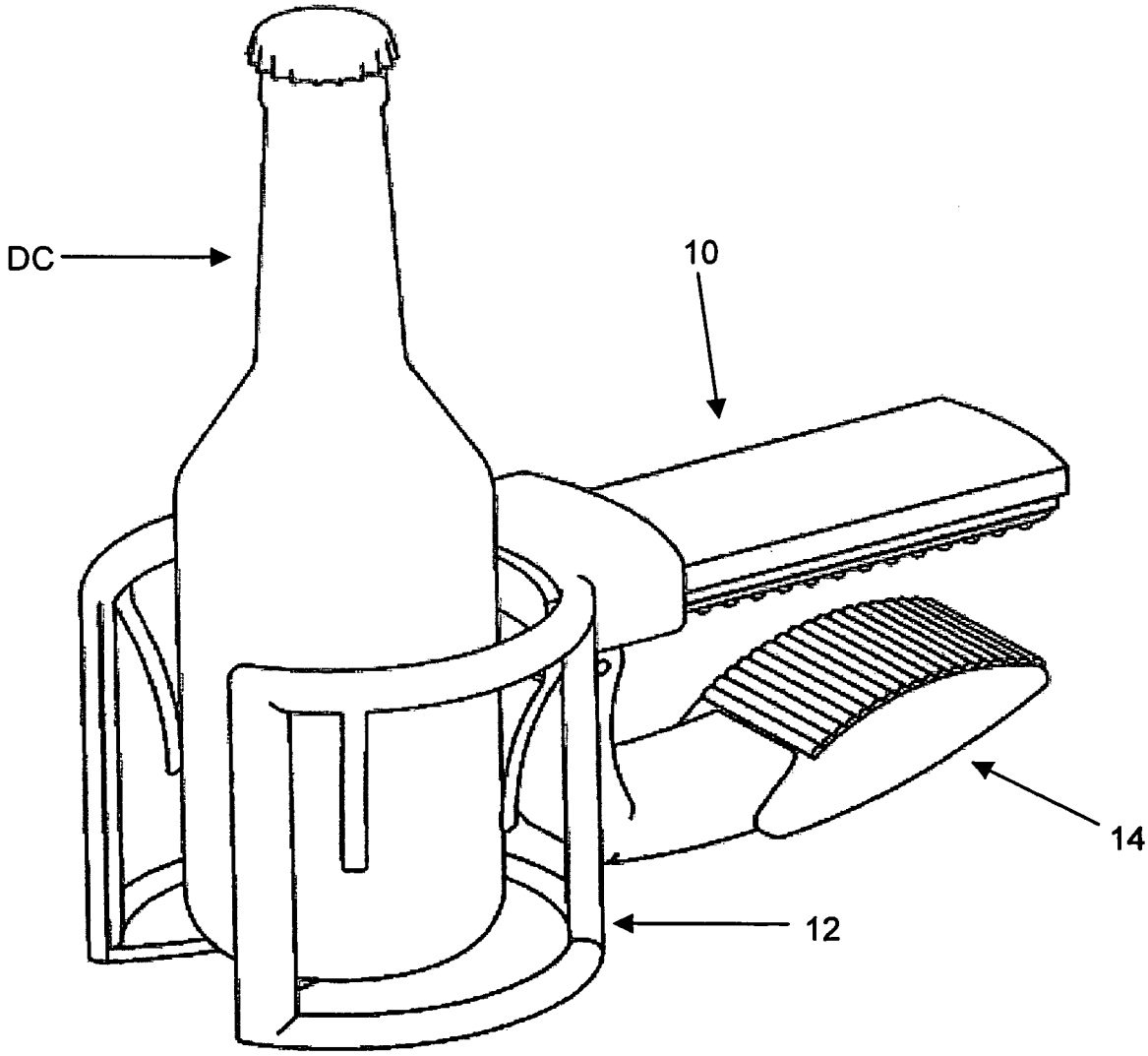
FIG. 3 is a perspective view of a beer bottle disposed within a drink holder system, in accordance with the general teachings of the present invention.

Referring to the Figures generally, and specifically to FIGS. 1 and 2, there is shown a drink holder system generally at 10. The drink holder system 10 includes a base assembly 12 and a clamp assembly 14. The base assembly 12 is operable to receive a drink container DC (e.g., a beer bottle), as specifically shown in FIG. 3. The drink container can include any number of types and shapes of vessels including but not limited to bottles, glasses, cups, mugs, cans and/or the like.

The base assembly 12 includes a C-shaped base member 100 having an open end 102, a C-shaped retainer member 104 having an open end 106, a plurality of leg members 108 interconnecting the base member 100 and the retainer member 104, and a plurality of selectively biasable prong members 110 extending from a surface of the retainer member 104.

The open ends 102, 106, respectively, should not be so large as to allow the drink container to become easily dislodged from the base assembly 12, e.g., if the user's hand knocks over the drink container.

The retainer member 104 is preferably spaced apart from the base member 100 (via the leg members 108) a sufficient distance so as to provide a suitable enclosure that is operable to receive a drink container, wherein the drink container cannot be easily dislodged from the base assembly 12 should be drink contained be knocked into, e.g., by the user's hand. However, the retainer member 104 should not be spaced so far from the base member 100 such that retrieving the drink container from the base assembly 12 is cumbersome, e.g., wherein the user has to reach deep down into the enclosure to retrieve the drink container.

Figure 4:
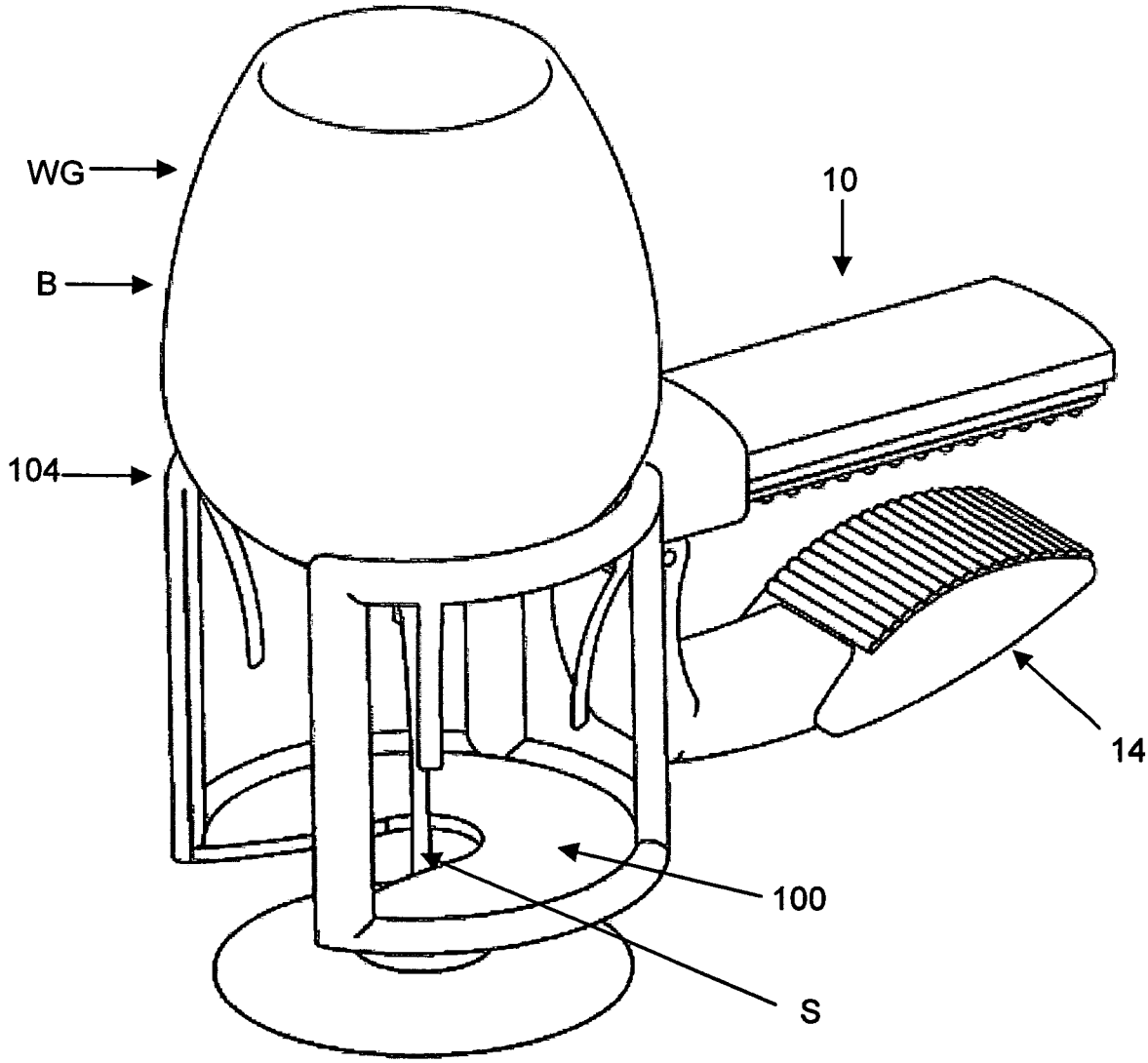
FIG. 4 is a perspective view of a wine glass disposed within a drink holder system, in accordance with the general teachings of the present invention.

In accordance with one aspect of the present invention, the open ends 102, 106, respectively, of the base member 100 and retainer member 104 align so as to permit the handle of a cup or mug to protrude therethrough. In accordance with another aspect of the present invention, the base member 100 and the retainer member 104 are aligned so as to form an area defining a throughbore 112 so as to permit, for example, the stem portion S of a wine glass WG to extend therethrough, while the cup or bowl portion B of the wine glass WG is supported by the base member 100 (e.g., for a glass that has a small or narrow bowl and/or base portion such as a champagne glass) and/or the retainer member 104 (e.g., for a glass that has a large or wide bowl and/or base portion such as a brandy snifter), as specifically shown in FIG. 4.

Although four leg members 108 are shown, it should be appreciated that either less than or more than this number can be used in the practice of the present invention. The prong members 110 are biasable so as to abut against the drink container and hold it relatively snuggly when the drink container is received in the base assembly 12. For example, the prong members 110 can be designed so as to snuggly engage a relatively small drink container, such as a juice glass, but be operable to bias away from the central axis of the base assembly 12 so as to accommodate relatively large or wide drink containers such as oversized coffee mugs, Mason jars and/or the like. Additionally, it should be appreciated that the diameter of the base assembly 12 can be configured to accommodate various size drink containers. For example, one size can be designed for adults, who would generally use relatively large drink containers, whereas another size can be designed for infants or toddlers who would use relatively small drink containers.

Figure 5:
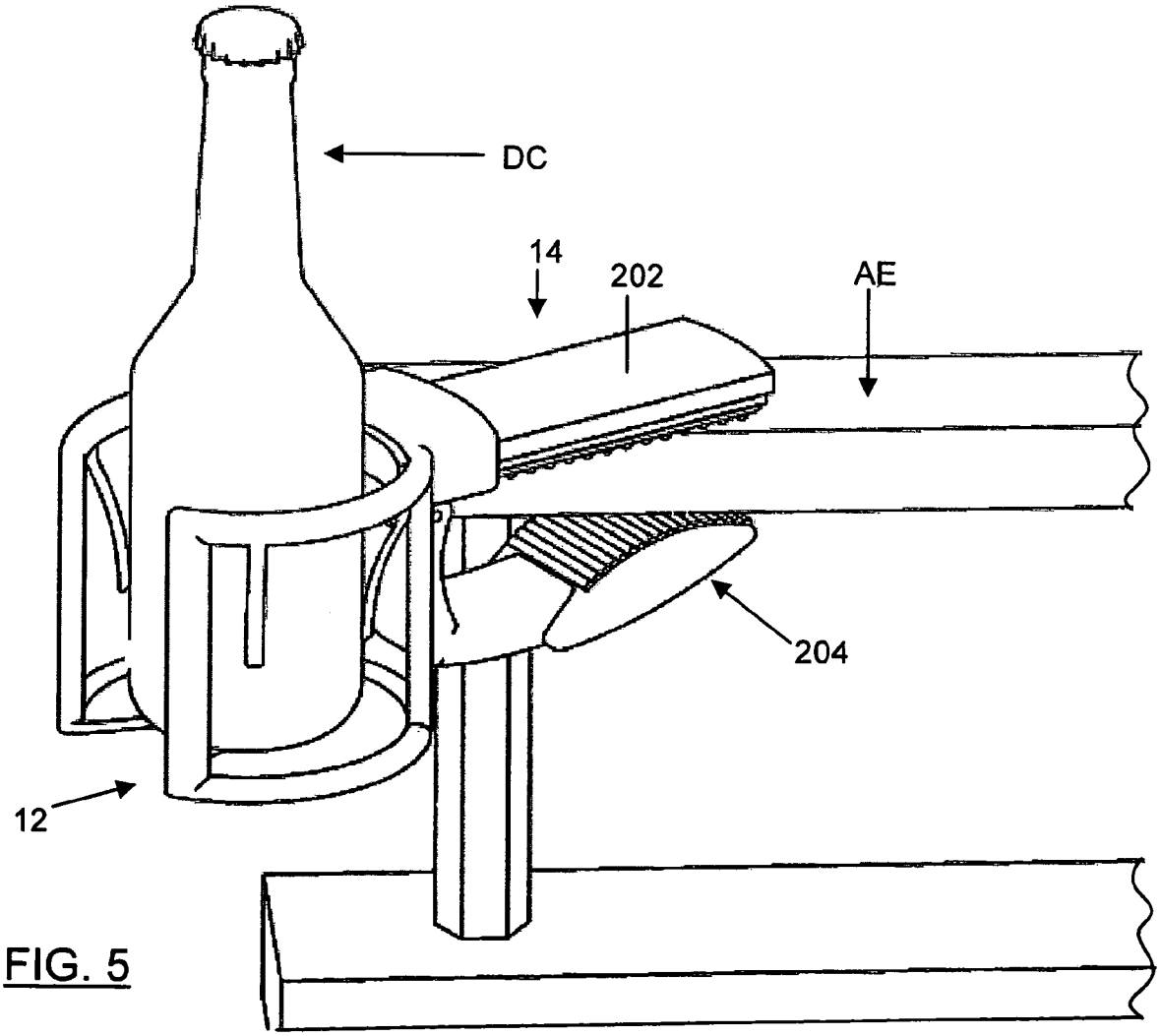
FIG. 5 is a partial perspective view of a beer bottle disposed within a drink holder system that is clamped to a chair, in accordance with the general teachings of the present invention.
Figure 6:
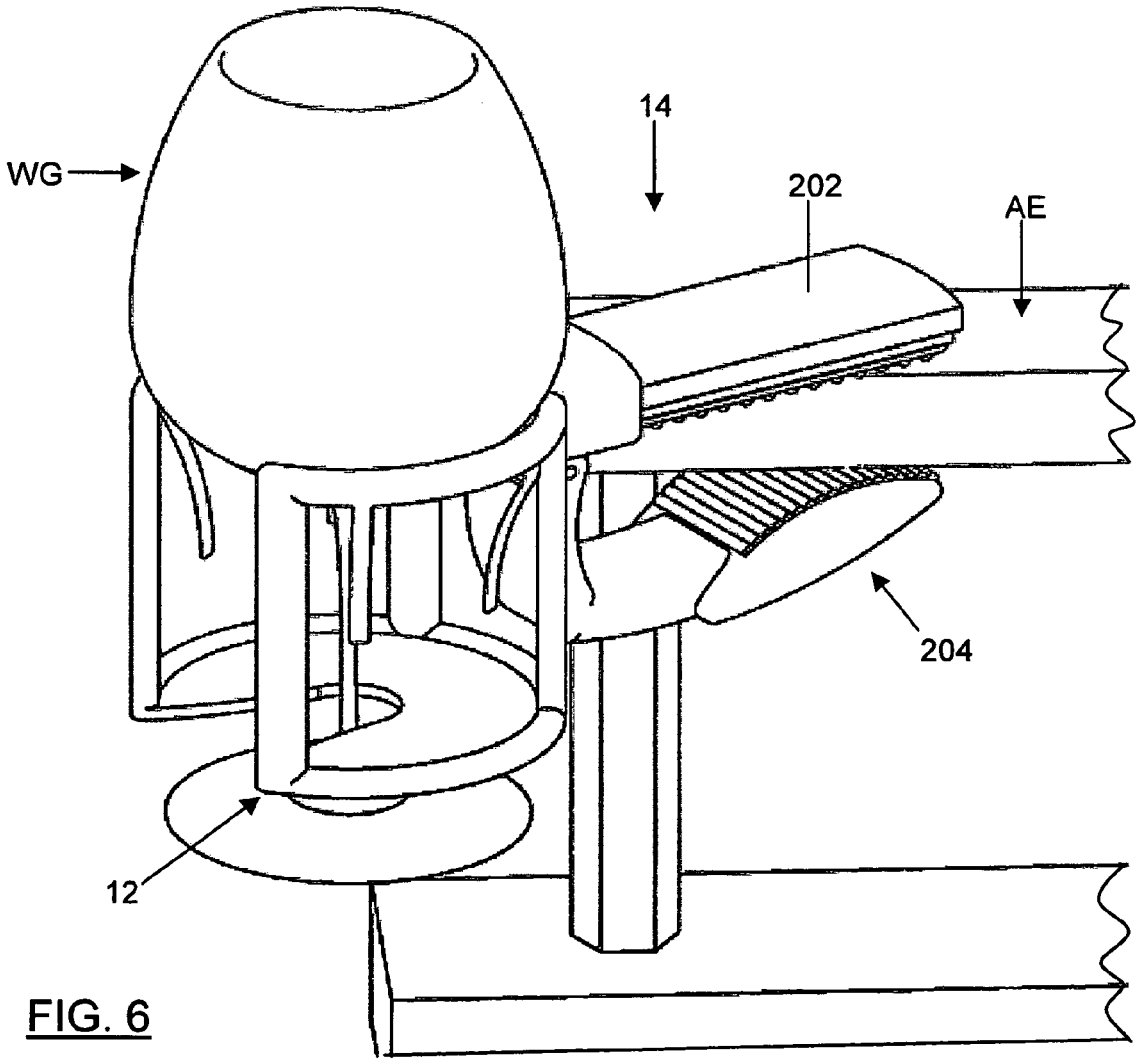
FIG. 6 is a partial perspective view of a wine glass disposed within a drink holder system that is clamped to a chair, in accordance with the general teachings of the present invention.
Figure 7:
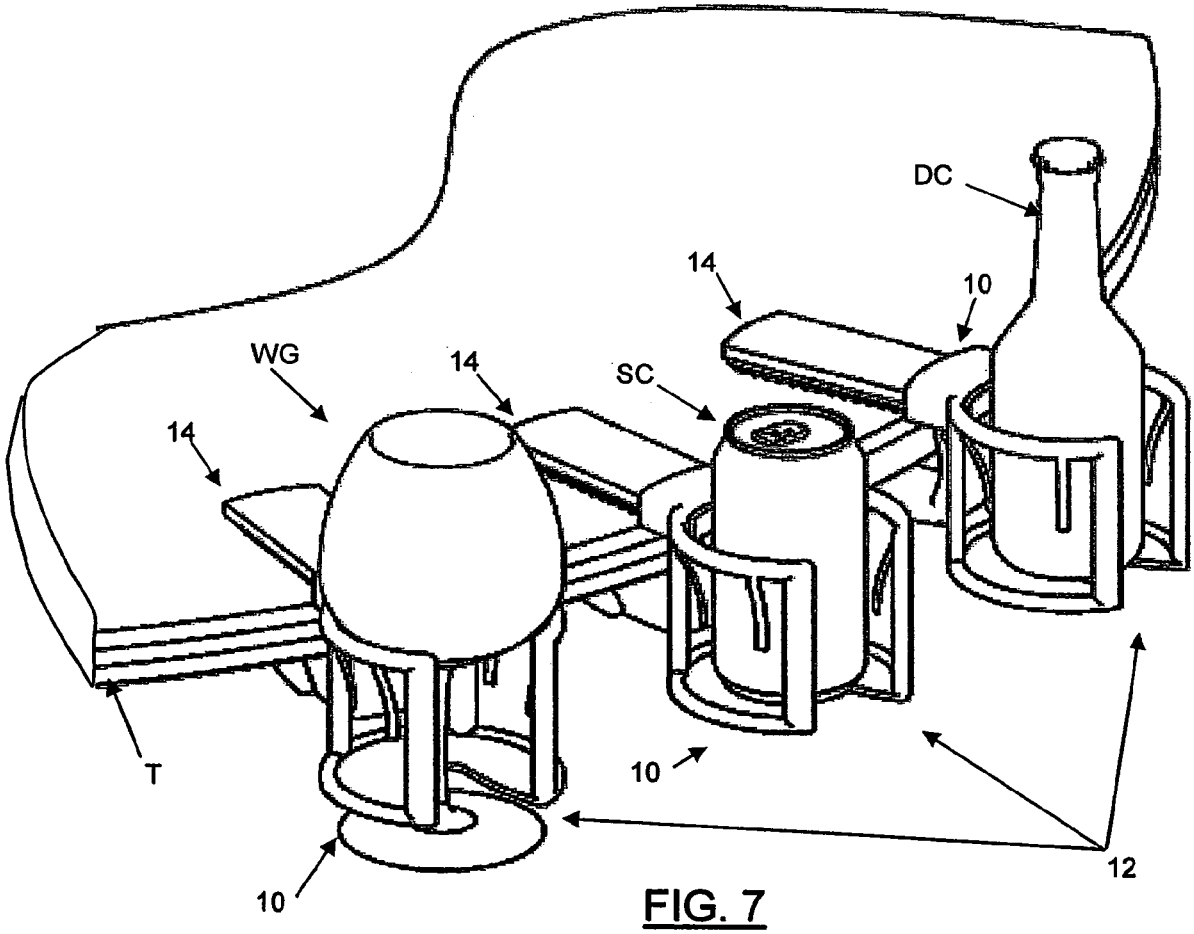
FIG. 7 is a partial perspective view of a beer bottle, soda can, and wine glass disposed within individual drink holder systems that are clamped to a patio table, in accordance with the general teachings of the present invention.

The clamp assembly 14 is operably associated with the base assembly 12. The clamp assembly 14 includes a bracket member 200 operably associated with the retainer member 104 (e.g., either via molding, bolting, gluing and/or the like), a first clamping member 202 slidably received in the bracket member 200, and a second clamping member 204 operably associated with the bracket member 200, wherein the second clamping member 204 is operable to bias away from the first clamping member 202 so as to permit the clamp assembly 14 to selectively clamp onto a surface, such as the edge portion of a structure, e.g., such as the arm edge AE of a chair C (as shown in FIGS. 5 and 6), the edge of a patio table T (as shown in FIG. 7, wherein a soda can SC is also shown being supported), and/or the like. The structure can include dining tables, card tables, end tables, coffee tables, window sills, bookcase shelves, ladder rungs, and/or the like, provided that the structure has a suitable surface (e.g., edge portion) to cooperate with the drink holder system 10.

The biasing motion can be provided with a biasing member 206 such as but not limited to a spring, hinge and/or the like operably associated with the bracket member 200 and the first clamping member 202. The biasing motion allows the clamp assembly 14, specifically the second clamping member 204, to expand to fit over an edge portion of a table, chair, or other structure and hold onto various thicknesses of surfaces.

The first clamping member 202 and the bracket member 200 can employ a tongue and groove mechanism to provide for the slidability therebetween. Alternatively, the first clamping member 202 can be received in an area defining an aperture formed in the bracket member 200, wherein the first clamping member 202 can be provided with a stop member 208 that prevents the first clamping member 202 from completely dislodging from the bracket member 200. The first clamping member 202 can also lock into place, e.g., when in a fully deployed position.

Figure 8:
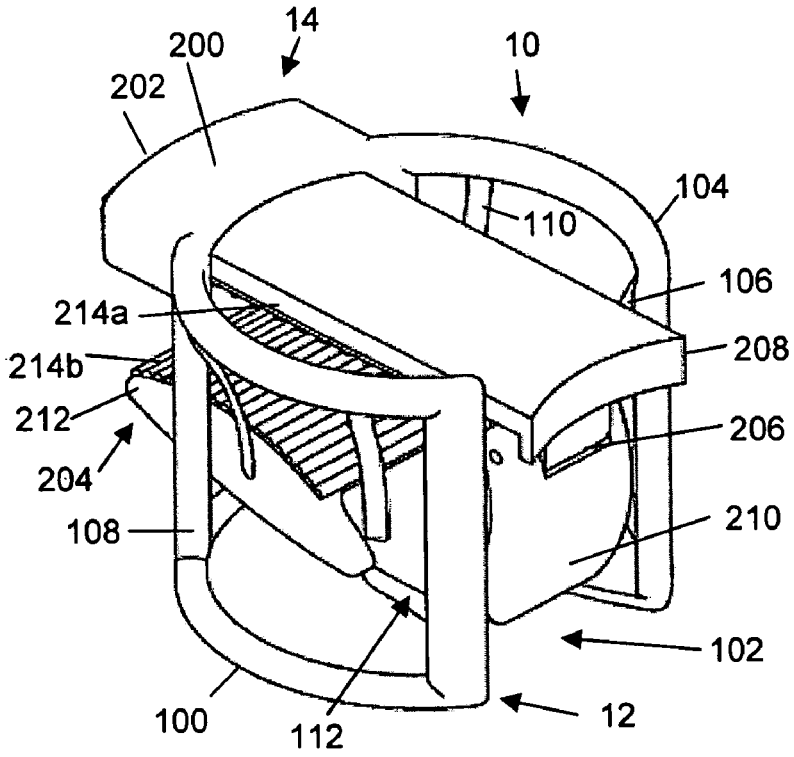
FIG. 8 is a top perspective view of a drink holder system in the stowed position, in accordance with the general teachings of the present invention.
Figure 9:
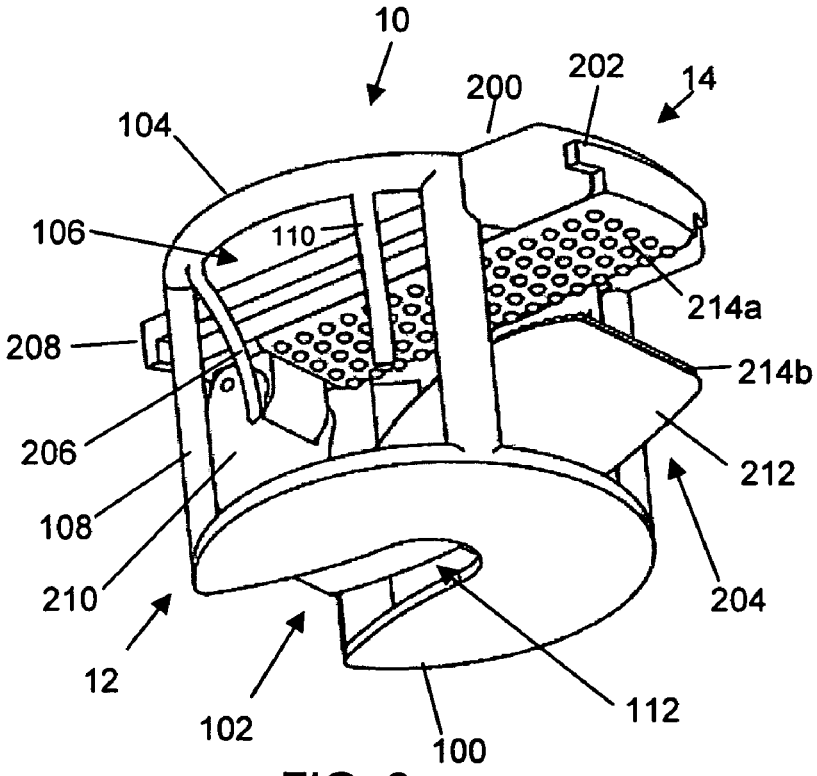
FIG. 9 is a bottom perspective view of a drink holder system in the stowed position, in accordance with the general teachings of the present invention.

Referring specifically to FIGS. 8 and 9, in order to provide a compacting feature to the drink holder system 10, the first clamping member 202 is operable to slide through the bracket member 200 such that the clamp assembly 14 is at least partially received in the base assembly 12. The clamp assembly 14 slides through an open portion 114 of the base assembly 12 (e.g., formed between two adjacent leg members 108). That is, the first and second clamping members 202, 204, respectively, are selectively operable to be at least partially received in the base assembly 12, e.g., through the open portion 114. This compacting feature is useful, for example, when the drink holder system 10 is no longer in use and needs to be stored.

The second clamping member 204 includes an L-shaped arm portion 210 and a curved end portion 212, wherein the arm portion 210 is operably associated with the bracket member 200, including the biasing member 206. The curved feature of the end portion 212 will permit the clamp assembly 14 to be secured to uneven surfaces. However, it should be appreciated that the end portion 212 can also be configured in a flat, as opposed to curved, shape.

In order to prevent slippage of the clamp assembly 14, one or more surfaces of the first and second clamping members 202, 204, respectively, can be provided with a non-slip material 214*a*, 214*b*, respectively, (e.g., rubber and/or the like) disposed on a surface thereof. In this manner, besides preventing slippage, the non-slip-material can also prevent scratching of the structure to which the drink holder system 10 is clamped to, e.g., a piece of fine furniture. The exact configuration of the non-slip material 214*a*, 214*b*, respectively, is not thought to be critical to the present invention provided that it performs a non-slip/non-scratch function. However, the non-slip material 214*a*, 214*b*, respectively, can be configured in a dimple and/or waffle pattern, a washboard pattern and/or the like.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A drink holder, comprising:

a base assembly operable to receive a drink container; and a clamp assembly operably associated with the base assembly, comprising:

a first clamping member having a free end;

a second clamping member having a free end;

wherein the first and second clamping members are spaced apart and oriented substantially parallel to one another; and a bracket member operably associated with the second clamping member;

wherein the second clamping member is operable to pivot about the bracket member independently of the first clamping member, so as to travel away from the first clamping member so as to permit the clamp assembly to selectively clamp onto a surface;

wherein the first clamping member is slidably received in the bracket member.

2. The invention according to claim 1, wherein the base assembly comprises:

a C-shaped base member having an open end;

a C-shaped retainer member having an open end; and a plurality of leg members interconnecting the base member and the retainer member.

3. The invention according to claim 2, wherein the base assembly further comprises a plurality of prong members extending from a surface of the retainer member.

4. The invention according to claim 3, wherein the prong members are selectively biasable.

5. The invention according to claim 2, wherein the bracket member is operably associated with the retainer member.

6. The invention according to claim 5, wherein the first or second clamping members are selectively operable to be at least partially received in the base assembly.

7. The invention according to claim 1, wherein the first or second clamping members include a non-slip material disposed on a surface thereof.

8. The invention according to claim 1, wherein the second clamping member further comprises an L-shaped arm portion and a curved end portion, wherein the arm portion is operably associated with the bracket member.

9. A drink holder, comprising:

a base assembly operable to receive a drink container, comprising:

a C-shaped base member having an open end;

a C-shaped retainer member having an open end; and a plurality of leg members interconnecting the base member and the retainer member; and a clamp assembly operably associated with the base assembly, comprising:

a first clamping member having a free end;

a second clamping member having a free end;

wherein the first and second clamping members are spaced apart and oriented substantially parallel to one another; and a bracket member operably associated with the second clamping member;

wherein the second clamping member is operable to pivot about the bracket member independently of the first clamping member, so as to travel away from the first clamping member so as to permit the clamp assembly to selectively clamp onto a surfacer;

wherein the first or second clamping members are selectively operable to be at least partially received in the base assembly.

10. The invention according to claim 9, wherein the base assembly further comprises a plurality of selectively biasable prong members extending from a surface of the retainer member.

11. The invention according to claim 9, wherein the bracket member is operably associated with the retainer member, wherein the first clamping member is slidably received in the bracket member.

12. The invention according to claim 9, wherein the first or second clamping members include a non-slip material disposed on a surface thereof.

13. The invention according to claim 9, wherein the second clamping member further comprises an L-shaped arm portion and a curved end portion, wherein the arm portion is operably associated with the bracket member.

14. A drink holder, comprising:

a base assembly operable to receive a drink container, comprising:

a C-shaped base member having an open end;

a C-shaped retainer member having an open end;

a plurality of leg members interconnecting the base member and the retainer member; and a plurality of selectively biasable prong members extending from a surface of the retainer member; and a clamp assembly operably associated with the base assembly, comprising:

a bracket member operably associated with the retainer member;

a first clamping member slidably received in the bracket member; and a second clamping member operably associated with the bracket member;

wherein the first and second clamping members are spaced apart and oriented substantially parallel to one another;

wherein the second clamping member is operable to pivot about the bracket member independently of the first clamping member, so as to travel away from the first clamping member so as to permit the clamp assembly to selectively clamp onto a surface.

15. The invention according to claim 14, wherein the first or second clamping members are selectively operable to be at least partially received in the base assembly.

16. The invention according to claim 14, wherein the first or second clamping members include a non-slip material disposed on a surface thereof.

17. The invention according to claim 14, wherein the second clamping member further comprises an L-shaped arm portion and a curved end portion, wherein the arm portion is operably associated with the bracket member.

* * * * *

UNITED STATES PATENT AND TRADEMARK OFFICE

CERTIFICATE OF CORRECTION

PATENT NO. : 7,284,737 B2
APPLICATION NO. : 11/214095
DATED : October 23, 2007
INVENTOR(S) : Jeffery L. Kane It is certified that error appears in the above-identified patent and that said Letters Patent is hereby corrected as shown below:

Column 6, line 23, delete “surfacer” and insert --surface--.

Signed and Sealed this

Twenty-fifth Day of December, 2007

JON W. DUDAS
*Director of the United States Patent and Trademark Office*